US005497595A

United States Patent [19]

Kalinin

[11] Patent Number: 5,497,595

[45] Date of Patent: Mar. 12, 1996

[54] METHOD OF REINFORCING WOOD BEAMS AND WOOD BEAMS MADE THEREFROM

[76] Inventor: Daniel Kalinin, 1779 Grosvenor Place, Mississauga, Ontario, Canada, L5L 3V8

[21] Appl. No.: 292,015

[22] Filed: Aug. 18, 1994

[51] Int. Cl.[6] ..... E04C 3/292

[52] U.S. Cl. ..... 52/737.3; 52/309.16; 52/730.7; 52/731.1

[58] Field of Search ..... 52/730.7, 821, 52/309.2, 309.16, 737.3, 731.1, 745.19

[56] References Cited

U.S. PATENT DOCUMENTS

| | | | |
|---|---|---|---|
| 1,084,276 | 1/1914 | Jaminet | 52/821 X |
| 3,605,360 | 10/1971 | Lindal | 52/730.7 X |
| 4,281,497 | 8/1981 | Luotonen et al. | 52/730.7 |
| 4,615,163 | 10/1986 | Curtis et al. | 52/730.7 |
| 4,879,160 | 11/1989 | Knudson et al. | 52/309.2 X |
| 4,965,973 | 10/1990 | Engebretsen | 52/223.8 |
| 5,050,366 | 9/1991 | Gardner et al. | 52/730.7 |

FOREIGN PATENT DOCUMENTS

| | | | |
|---|---|---|---|
| 2531656 | 2/1977 | Germany | 52/730.7 |
| 203684 | 4/1966 | Sweden | 52/730.7 |
| 1675514 | 9/1991 | U.S.S.R. | 52/730.7 |
| 2003957 | 3/1979 | United Kingdom | 52/730.7 |

*Primary Examiner*—Carl D. Friedman
*Assistant Examiner*—Christopher Todd Kent
*Attorney, Agent, or Firm*—Jeffrey T. Imai; D. Doak Horne; Arne I. Fors

[57] ABSTRACT

A reinforced wood beam has a length and a longitudinally extending upper and lower surface. The upper and lower surfaces have a plurality of reinforcements. Each reinforcement comprises a steel strip bonded within a longitudinally extending kerf. The upper and lower surfaces each has at least two kerfs extending therealong and terminate intermediate of ends of the wood beam.

7 Claims, 2 Drawing Sheets

METHOD OF REINFORCING WOOD BEAMS AND WOOD BEAMS MADE THEREFROM

FIELD OF THE INVENTION

This invention relates to a method of reinforcing wood beams and the wood beams made therefrom.

BACKGROUND OF THE INVENTION

Wood beams are a common structural component, particularly in residential buildings. Wood beams are commonly used as joists which span between two support points for supporting floors and ceilings.

Wood beams come in a variety of standard sizes, including 2×6, 2 ×8, 4×8, 4×10 and 6×12. Each size of beam has known and accepted characteristics of strength and deflection.

In designing a building, once the static and dynamic loads have been calculated the designer can select the size of the wood beam which will be used as the floor or ceiling joists. On selection of the size of beam, building codes and construction practices dictate the number and spacing of the joists.

In selecting the size of beam to be used a joist, the cost is a significant factor. Smaller size beams are generally less expensive than larger size beams. However, with smaller size beams, more beams are required to achieve the same load capacity. There is normally a trade off between the size of beams and the number of beams.

It would thus be advantageous if a smaller sized beam could be reinforced to increase the strength characteristics thereof in order to increase load capacity when used as a joist without dramatically increasing the cost.

SUMMARY OF THE INVENTION

The disadvantages of the prior art may be overcome by providing a wood beam with a plurality of longitudinally extending reinforcements in the upper and lower surfaces thereof. Each reinforcement comprises a length of steel glued or bonded into a kerf or groove in each of the upper and lower surfaces thereof.

According to one aspect of the invention, there is provided a reinforced wood beam having a length and a longitudinally extending upper and lower surface. The upper and lower surfaces have a plurality of reinforcements. Each reinforcement comprises a steel strip bonded within a longitudinally extending kerf. The upper and lower surfaces each has at least two kerfs extending therealong.

According to another aspect of the invention, the kerfs terminate intermediate of ends of the wood beam.

According to another aspect of the invention, the kerfs are staggered along the length of the wood beam.

According to another aspect of the invention, there is provided a method of manufacturing a reinforced wood beam. The method comprises the steps of:

cutting a plurality of longitudinally extending kerfs in an upper and lower surface of a wood beam, inserting a bead of adhesive along the length of each of the kerfs, inserting a steel strip in each of the kerfs, and allowing the bead of adhesive to harden.

DESCRIPTION OF THE DRAWINGS

In figures which illustrate the embodiments of the invention.

DETAILED DESCRIPTION OF INVENTION

Figure 1:
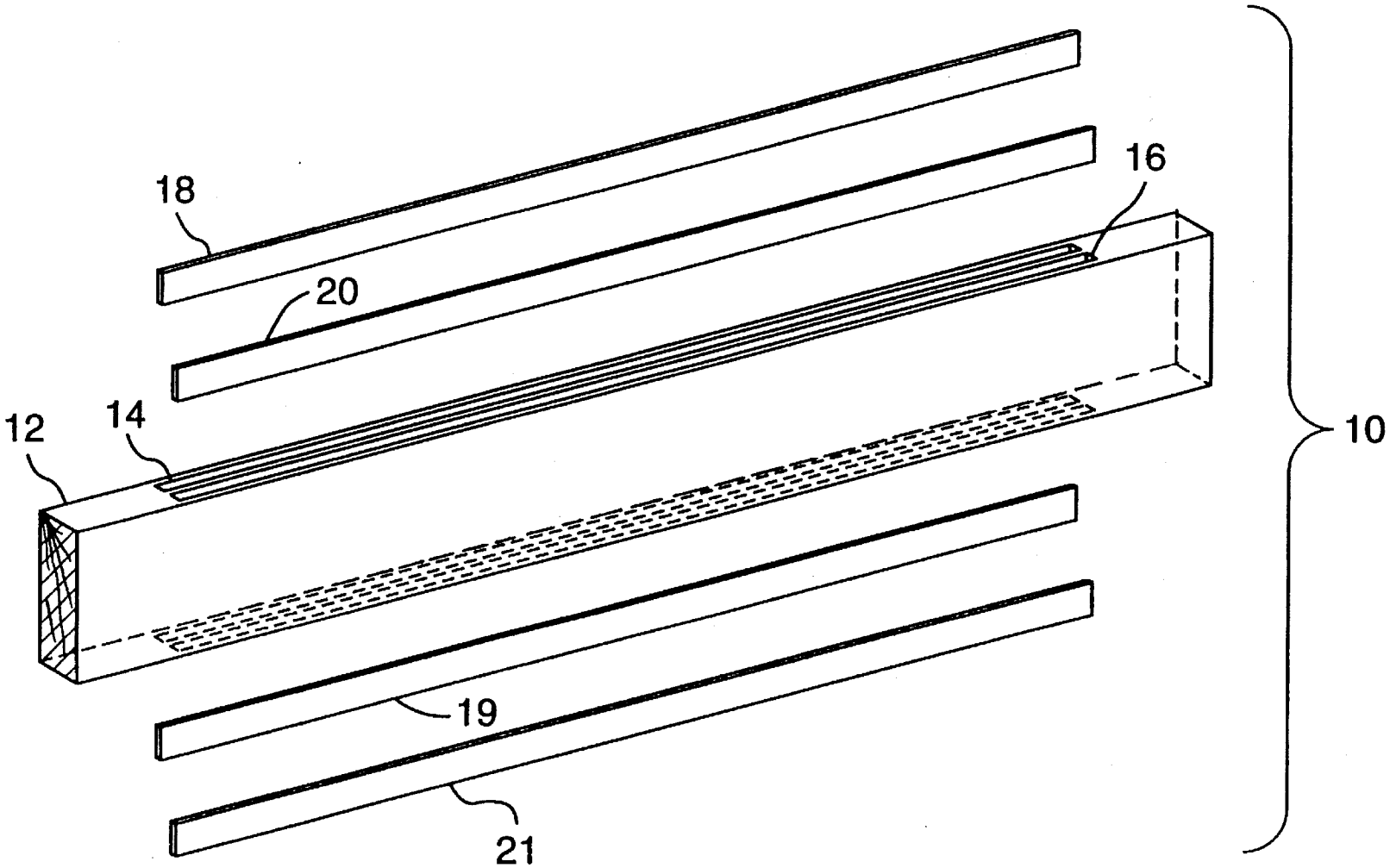
FIG. 1 is a perspective view of the reinforced wood beam of the present invention.
Figure 2:
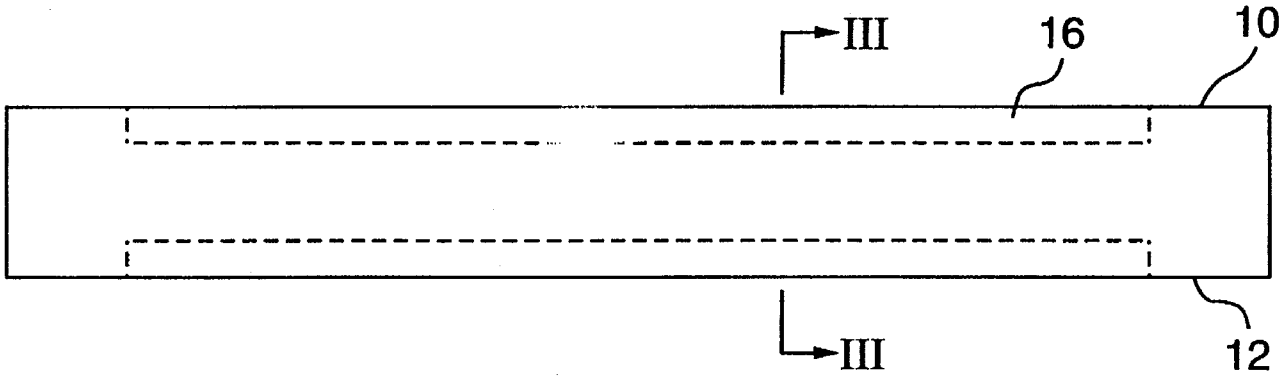
FIG. 2 is a side elevational view of the reinforced wood beam of FIG. 1.

FIG. 1 generally illustrates the reinforced wood beam of the present invention. Reinforced beam 10 comprises a wood beam 12 having a plurality of kerfs or grooves cut into the upper (14, 16) and lower surfaces (15, 17) thereof. Embedded within grooves 14, 15, 16 and 17, are steel reinforcements 18, 19, 20 and 21, respectively.

To manufacture the wood beam of the present invention, the kerfs 14, 15, 16 and 17 are cut in the upper and lower surfaces of the beam. A conventional table saw or router with guides may be used for this purpose. A bead of epoxy resin is ejected into the upper kerfs 14 and 16. Reinforcements 18 and 20 are then hammered into the kerfs 14 and 16 securing reinforcements 18 and 20 within the epoxy resin which is then allowed to harden. The beam is flipped over and the process repeated for kerfs 15 and 17 and the insertion of reinforcements 19 and 21.

The kerfs 14, 15, 16 and 17 extend longitudinally of the beam but preferably do not extend the entire length. The steel reinforcements equally do not extend the entire length. By terminating the reinforcements intermediate of the length of the beam, the ends of the beams may be cut off without damaging the reinforcement after the epoxy resin has hardened. If the reinforced beam is cut, not only is a special saw blade required but also the integrity of the bond between steel reinforcement and the wood beam may be compromised. A carpenter would be required to change saw blades to a metal cutting saw blade which increases the time for installation.

In use, the ends may be cut to fit the span between supports or to make fire cut ends.

Any type of two part epoxy resin may be used. Applicant has found that the two component epoxy available under the trade-mark PERMAQUICK 2030 provides satisfactory results.

Applicant has also found that sheet steel meeting ASTMA 446 Grade A cold rolled, mild grade steel will produce satisfactory results.

In the preferred embodiment illustrated in FIG. 1, the beam has two longitudinally extending reinforcements 18 and 20 on the upper surface and two longitudinally extending reinforcements 19 and 21 on the lower surface. A satisfactory beam could be manufactured using only a single reinforcement in each of the upper and lower surfaces. However, the reinforcements would be required to be sized larger than the reinforcements used in the following example to achieve the same strength characteristics.

Two smaller reinforcements has the additional advantage that the kerfs are spaced towards the longitudinal edges of the upper and lower surfaces, leaving a strip of wood extending between the reinforcements. Normally, a carpenter will aim for the center of the joist when nailing. The two smaller reinforcements reduces the likelihood of nailing into the epoxy or the steel reinforcement.

EXAMPLE 1

The reinforced joist was made of No. 1 and 2 grade SPF dimension lumber and sheet steel strips glued into top and bottom edges. A 2×8 (38×184 mm) joist and 1" 14 gauge (25×1.9 mm) strips of ASTMA 446 Grade A Steel was manufactured. Two parallel saw kerfs were cut in each of the top and bottom surfaces using a 2 mm blade. The kerfs were cut to a depth of 30 mm and spaced at 12 mm. A bead of two part epoxy resin was applied to each saw kerf and then the steel strips were pressed into place. The joist length was 4.27 meters with the steel strips having 2.74 meter length and centered in the length of the joist.

Recommended Maximum Spans

In the National Building Code of Canada 1990, the maximum spans for residential floor joists are based on several criteria. First, the bending moment capacity of the joist must not be exceeded. Second, the shear capacity of the joist must not be exceeded. Third, the live load deflection must not exceed 1/360 of the span. Fourth, the vibration-controlled span must not be exceeded.

Bending Moment Resistance

For lumber products, design values are calculated on the basis of the lower fifth percentile of the population strength. For green reinforced lumber the value is 18.2 MPa. A basic dry characteristic value may be derived from this by applying a factor of 0.80 for load adjustment. The result is a characteristic bending strength of 17.2 MPa. This may be compared with the value of 11.8 MPa for unreinforced SPF joists in CAN3-086.1-M-89. The reinforcement produces an improvement of 46% in bending strength.

The factored moment resistance for single joists in Limit States Design is calculated by:

$$\begin{aligned} M_r &= \phi F b s \\ &= 0.9 \times 17.3\ \text{MPa} \times 0.214 \times 10^6\ \text{mm}^3 \\ &= 3.33\ \text{kN} \cdot \text{m} \end{aligned}$$

In typical floor construction this may be increased by a load sharing system adjustment. The adjustment for unreinforced sawn lumber is 1.40. For the reinforced joist, the factor is assumed to be 1.20 recognizing that the variability of this product is reduced. Thus the floor system moment resistance would be 4.0 kN.M.

Shear Resistance

The reinforcement in these joists is intended to improve the extreme fiber strength and stiffness. As such it does not improve or otherwise affect the longitudinal shear strength of the wood. Therefore, the published factored shear resistance is:

$$V_r = 5.03\ \text{kN}$$

As noted for moment resistance, the shear capacity may be adjusted in load sharing systems. For uniformity we recommend that this factor be 1.20. Thus the floor system shear resistance would be 6.0 kN.

Live Load Deflection

The test results for the green material show a mean stiffness value of $382 \times 10^9$ N.mm$^2$.

Deflection-limited floor spans may be calculated from the dry EI. For a live load of 1.9 kPa, a spacing of 400 mm and a limiting deflection of 1/360, the maximum span is 4.65m.

Vibration Controlled Span

This span is calculated according to National Building Code of Canada 1990 using a mid-span load of 1.0 kN with a maximum of 2 mm deflection. This span varies depending upon the floor type and whether strapping and bridging are present. For the case of 400 mm spacing, 15.5 mm nailed subfloor and strapping only, the maximum span is 3.90 m. This span is shorter than the live load deflection span and so vibration will be the limiting design criterion.

Summary

Load testing was done to determine design properties for steel-reinforced 38×184 wood joists. Recommended properties for Limit States Design in load sharing systems are as follows:

| | |
|---|---|
| Factored Moment Resistance | 4.0 kN · m |
| Factored Shear Resistance | 6.0 kN |
| Stiffness | $359 \times 10^9$ N · mm$^2$ |

Maximum spans for residential floors have been calculated using the above properties and the procedures recommended by National Building Code of Canada 1990. The results are found in Table 1.

It has been found that the load share between the wood and reinforcement is about 42% carried by the wood and about 58% carried by the reinforcement. The tested samples of 2×8 beams according to the present invention were found to have an actual stiffness improvement over an unreinforced beam by about 1.92.

In use, a 2×8 reinforced beam according to the present invention has an equivalent strength and load characteristics of a unreinforced 2×10 wood beam. In a building, there may be a requirement for a joist over a 14 foot span, which requires a 2×10 beam. Since a 2×10 joist is required, all other joists and headers must 2×10, even though the other shorter spans could use a 2×8 joist. By using a 2×8 joist according to the present invention over the 14 spans, the remainder of the floor joists could use unreinforced 2×8 joists. This results in cost savings not only being able to use lesser priced unreinforced 2×8 joists but also for savings in cladding materials due to the 2 inch difference.

Figure 4:
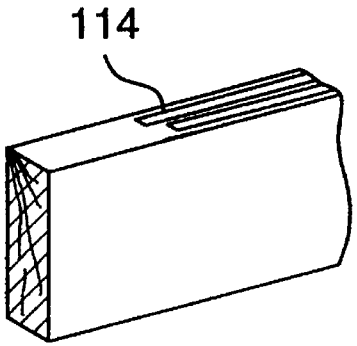
FIG. 4 is a partial perspective view of a second embodiment of the present invention.
Figure 4:
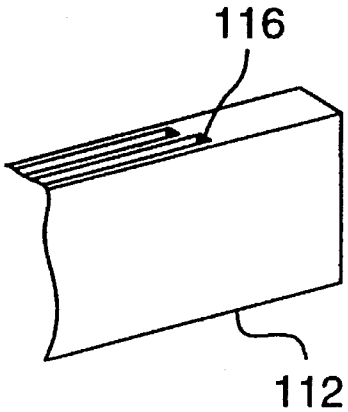
Figure 3:
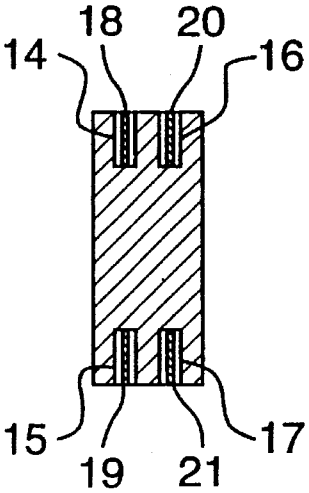
FIG. 3 is a cross-sectional view of the reinforced wood beam of FIG. 1 along the lines III—III of FIG. 2.

Referring to FIG. 4, a second embodiment of the present invention is illustrated. In this embodiment, the kerfs 114 and 116 are staggered along the length of the wood beam 112.

It is now apparent to a person skilled in the art that the reinforced wood beam of the present invention could be readily modified. It is understood that certain changes in style, size and components may be effective without departure from the spirit of the invention and within the scope of the appended claims.

TABLE 1

| | Maximum Span in Meters Living Area Floors | | |
|---|---|---|---|
| Spacing (mm) | Strapping only | Bridging only | Strapping & Bridging |
| 300 | 4.10 | 4.39 | 4.61 |
| 400 | 3.90 | 4.13 | 4,29 |
| 600 | 3.70 | 3.90 | 3.91 |

I claim:

1. A reinforced wood beam having a longitudinally extending upper and a lower surface, said upper and lower surfaces having a plurality of reinforcements bonded therein, said reinforcements each comprising a steel strip bonded within a longitudinally extending kerf, said reinforcements spaced from a midpoint of a width of said wood beam.

2. A reinforced beam as claimed in claim 1 wherein said upper and lower surfaces each has at least two of said kerfs extending therealong.

3. A reinforced beam as claimed in claim 2 wherein said kerfs terminate intermediate of ends of said wood beam.

4. A reinforced beam as claimed in claim 3 wherein said kerfs are staggered along the length of said wood beam.

5. A reinforced beam as claimed in claim 1 wherein said steel strip is bonded with a two component epoxy resin.

6. A reinforced beam as claimed in claim 1 wherein each of said kerfs has a kerf width, and each of said kerf widths to the width of said surfaces is in a ratio of about 1 to 20.

7. A reinforced beam as claimed in claim 6 wherein said upper and lower surfaces each has two reinforcements.

* * * * *